US005657715A

United States Patent [19]

Theriault

[11] Patent Number: 5,657,715

[45] Date of Patent: Aug. 19, 1997

[54] MARITIME SURVIVAL CAPSULE

[76] Inventor: Vincent Theriault, C.P. 25 Grande-Anse, New Brunswick, Canada, E0B 1R0

[21] Appl. No.: 535,247

[22] PCT Filed: May 2, 1994

[86] PCT No.: PCT/CA94/00204

§ 371 Date: Jan. 16, 1996

§ 102(e) Date: Jan. 16, 1996

[87] PCT Pub. No.: WO94/25337

PCT Pub. Date: Nov. 10, 1995

[30] Foreign Application Priority Data

May 1, 1993 [GB] United Kingdom ..... 9309102

[51] Int. Cl.[6] ..... B63C 9/06

[52] U.S. Cl. ..... 114/349; 114/362; 114/363

[58] Field of Search ..... 114/201 R, 201 A, 114/348, 349, 350, 346, 363, 270, 362; 441/38, 39

[56] References Cited

U.S. PATENT DOCUMENTS

| | | | |
|---|---|---|---|
| 1,204,937 | 11/1916 | Carley | 440/19 |
| 1,300,906 | 4/1919 | Whitaker | 114/349 |
| 2,129,742 | 9/1938 | Mason | 114/350 |
| 3,896,515 | 7/1975 | Otterman | 114/349 |
| 4,365,579 | 12/1982 | Perez, Jr. | 114/349 |
| 4,665,653 | 5/1987 | Franz et al. | 114/201 A |

FOREIGN PATENT DOCUMENTS

| | | | |
|---|---|---|---|
| 1506298 | 12/1967 | France | 114/349 |
| 14420 | 9/1905 | Norway | 114/349 |

*Primary Examiner*—Edwin L. Swinehart
*Attorney, Agent, or Firm*—R. Craig Armstrong

[57] ABSTRACT

A maritime survival capsule is shaped like a somewhat elongted egg, and has an inside shell which is moulded slightly smaller. Features of the capsule include: a front end porthole; a front end opening, for the tow line, anchor line, or sea anchor; a chain/rope locker, which, when a plastic bag liner is employed, also functions as a toilet; a ballast tank system which floods with water when the capsule is placed in water, an internal seating system; a multi-function device which functions as a dagger board/keel, a rudder, and a propulsion system; a conventional diaphragm-type bilge pump or pumps; special internal geometry which enables occupants to wedge themselves securely in place; an entry system comprised in part of strategically placed handles inside the capsule; a multi-feature door system; a life supporting environmental system, dealing with the requirements for control of heat loss, humidity control, air exchange, and cooling; a submersible feature, which enables the capsule containing the occupants to be submerged and then launched safely from under water, either inadvertently, or intentionally; a fully circular profile, above and below the normal water line; a launching system which rigidly holds the capsule affixed to the vessel until the occupants have been boarded, with launching being automatic, through a hydrostatic release, or manually; miscellaneous compartments for stowing supplies; and foam flotation.

5 Claims, 19 Drawing Sheets

MARITIME SURVIVAL CAPSULE

TECHNICAL FIELD

This invention relates to a maritime survival capsule, and various features thereof. The capsule is intended for emergency use, such as when a ship is sinking.

DISCLOSURE OF INVENTION

The capsule is shaped like a somewhat elongated egg, i.e. generally elliptical, but with one end larger than the other it is approximately 2.75 m long by 1.2 m diameter (9 feet long by 4 feet diameter) outside. It has an inside shell which is moulded slightly smaller, generally to permit about 3 cm (1¼ inches) of balsa core spacer.

General features observed on the capsule (starting from the smaller end, which is termed the bow) include:

1. A front end porthole, for visibility.
2. A front end opening, for the tow line, anchor line, or sea anchor.
3. A chain/rope locker, which, when a plastic bag liner is employed, also functions as a toilet.
4. A ballast tank system which floods with approximately 100 kg. (225 pounds) of water when the capsule is placed in water.
5. A seat system designed ergonomically for comfort over extended periods.
6. A multi-function device which functions as a dagger board/keel, a rudder, and a propulsion system.
7. Conventional diaphragm-type bilge pumps.
8. Special internal geometry which enables occupants to wedge themselves securely in place.
9. An entry system comprised in part of strategically placed handles inside the capsule.
10. A multi-feature door system.
11. A life supporting environmental system, dealing with the requirements for control of heat loss, humidity control, air exchange, and cooling.
12. A submersible feature, which enables the capsule containing the occupants to be submerged and then launched safely from under water, either inadvertently, or intentionally.
13. A fully circular profile, above and below the normal water line.
14. A launching system which rigidly holds the capsule affixed to the vessel until the occupants have been boarded, with launching being automatic, through a hydrostatic release, or manually.
15. Miscellaneous compartments for stowing supplies.
16. Foam flotation.

BRIEF DESCRIPTION OF DRAWINGS

The invention will now be described with reference to the accompanying drawings, in which.

BEST MODE FOR CARRYING OUT THE INVENTION

Figure 1:
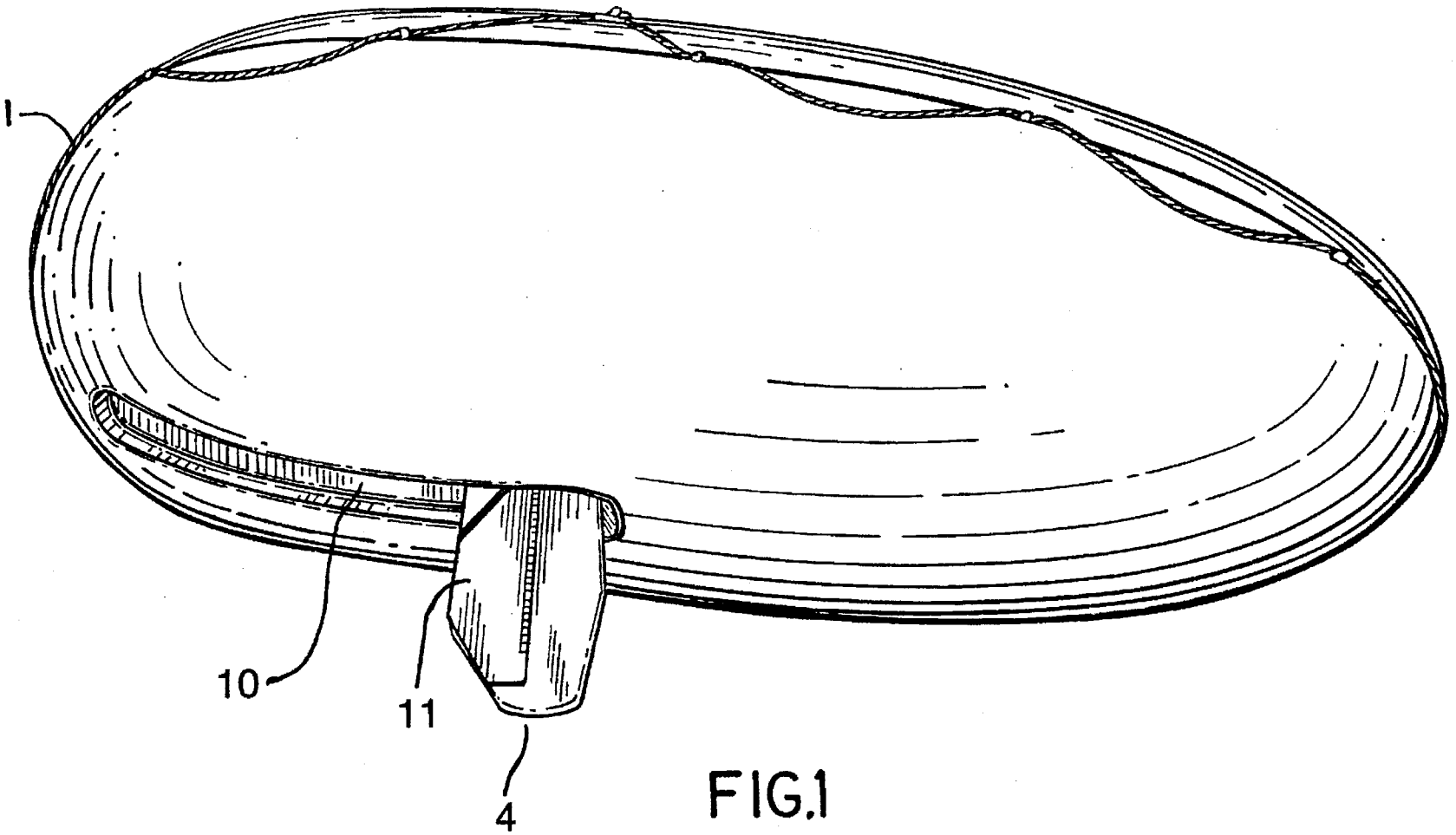
FIG. 1 shows the capsule lying on its side, with the bottom visible.
Figure 2:
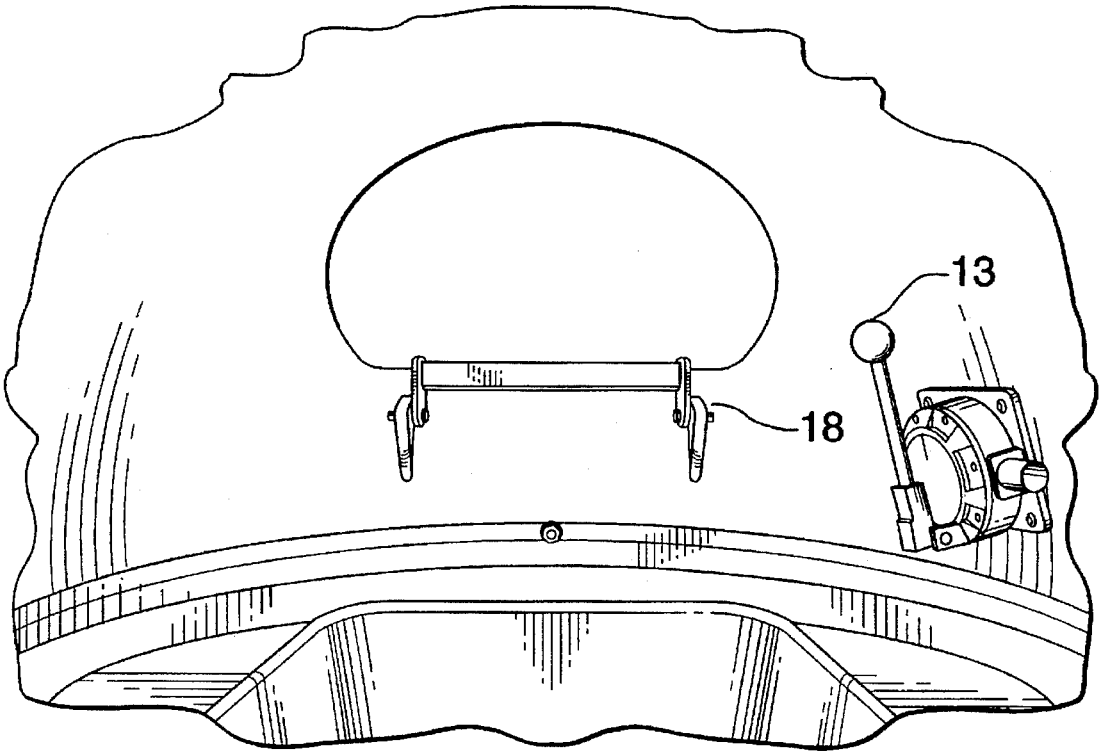
FIG. 2 shows the hatch area, viewed from inside.
Figure 3:
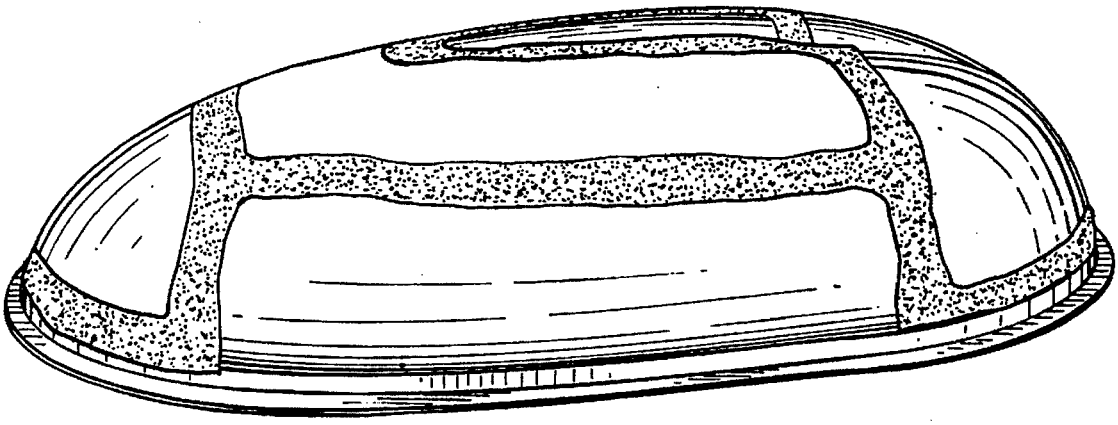
FIG. 3 shows the hull liner inverted.
Figure 4:
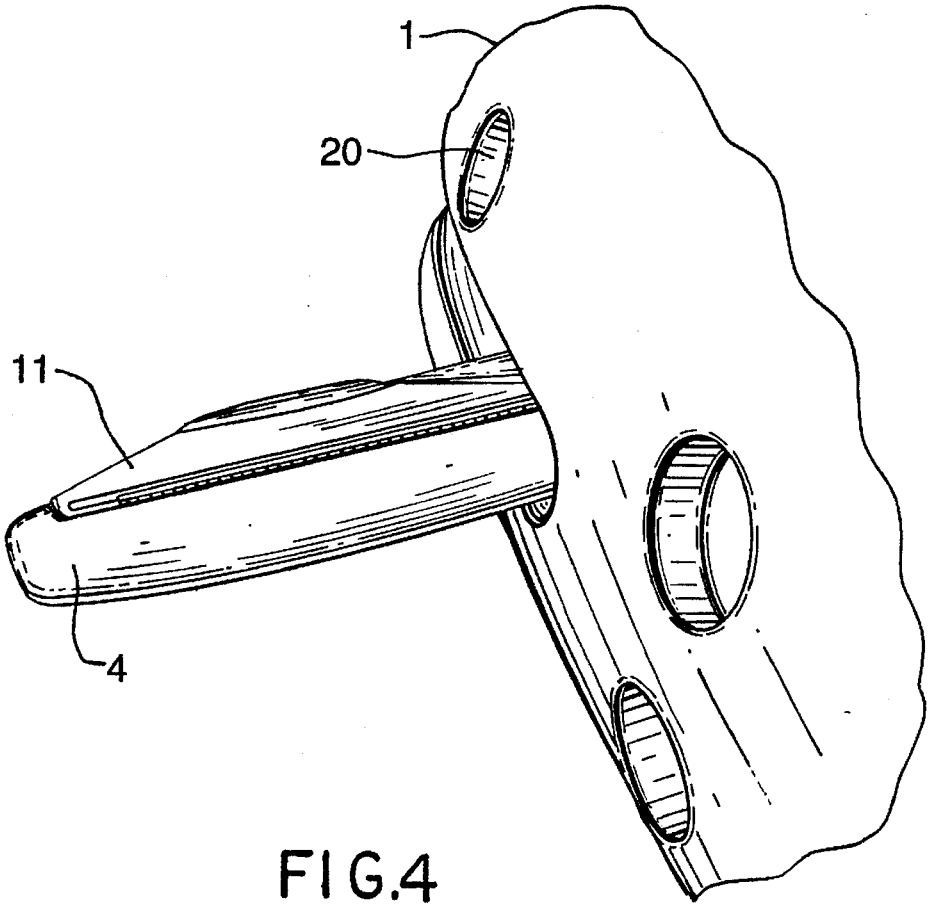
FIG. 4 shows the dagger board fully forward with the blades or flaps closed.
Figure 5:
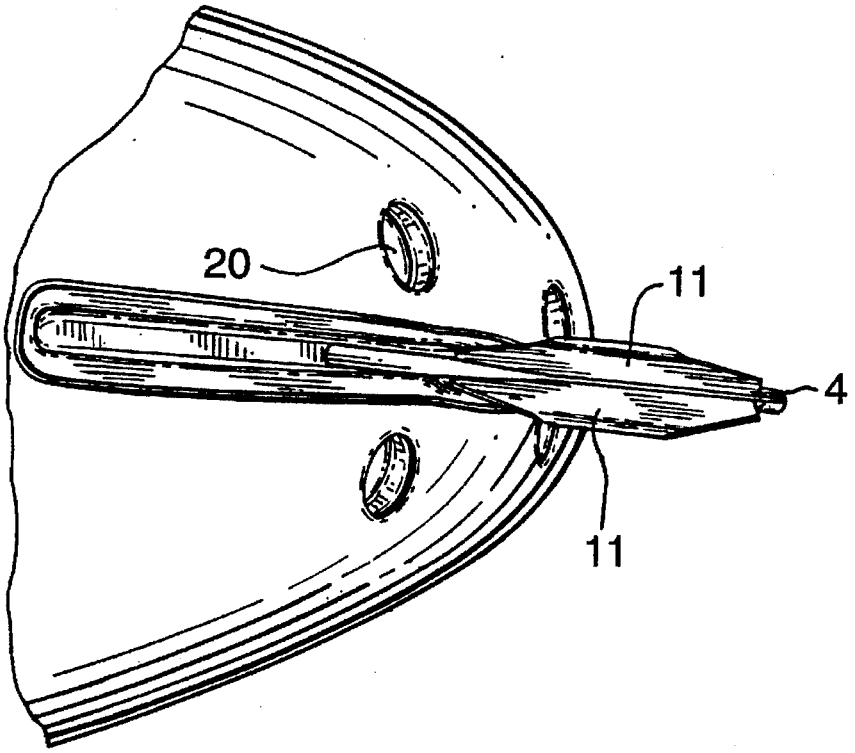
FIG. 5 shows the dagger board with the flaps opening, viewed from behind.
Figure 6:
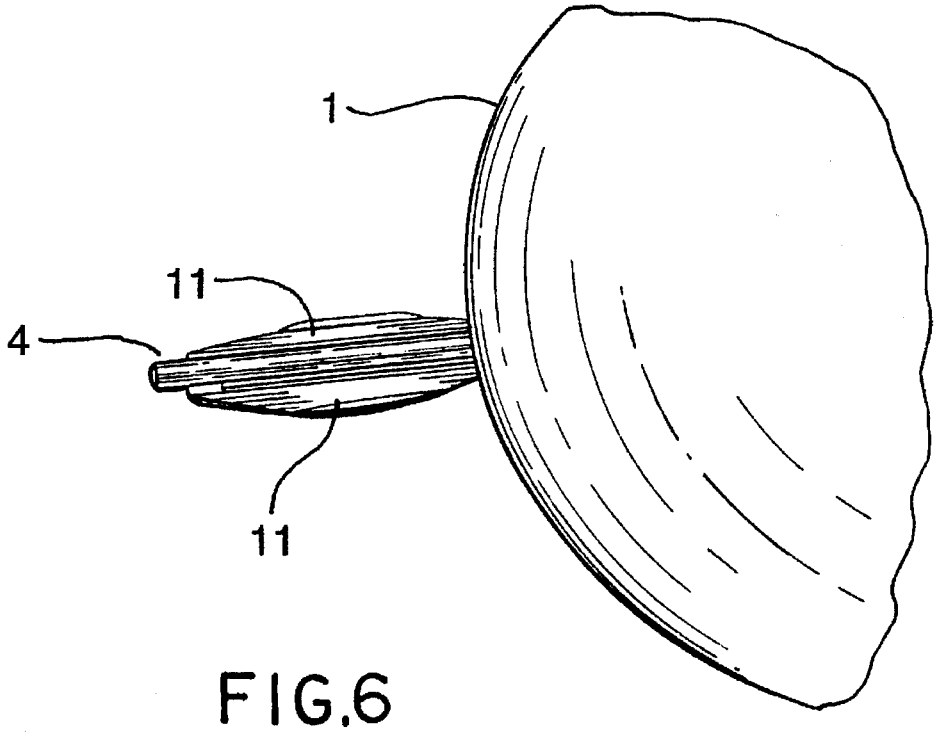
FIG. 6 shows the dagger board with the flaps open, viewed from the front.
Figure 7:
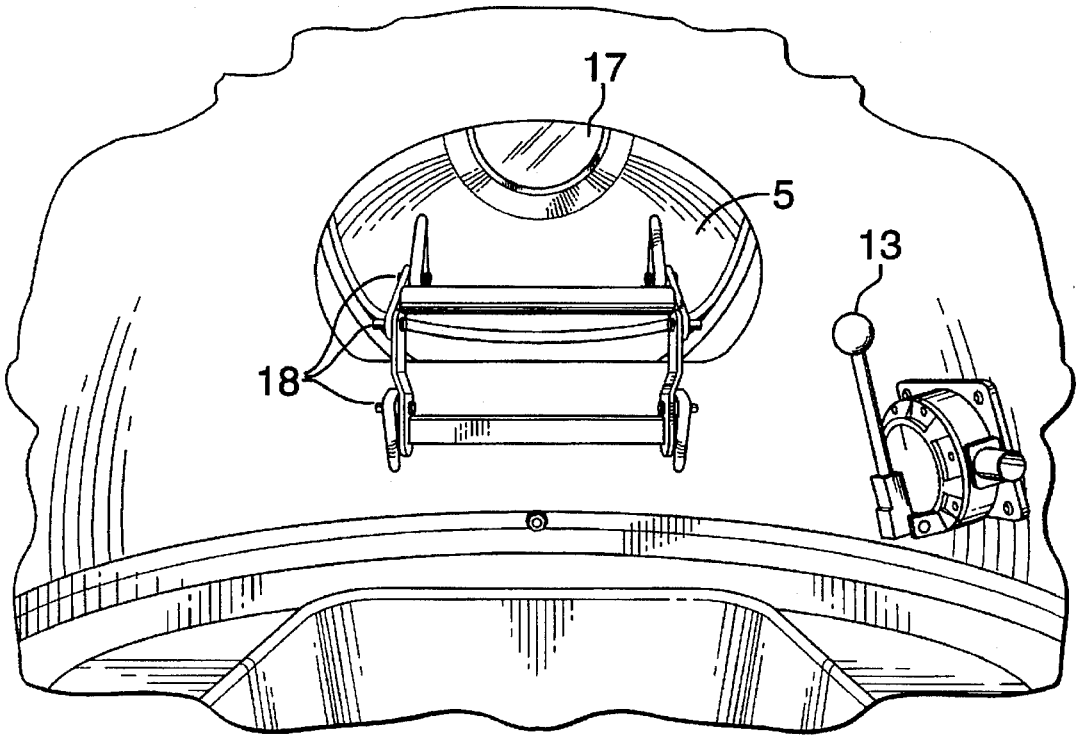
FIG. 7 the hatch area, viewed from the inside, with the hatch closing.
Figure 8:
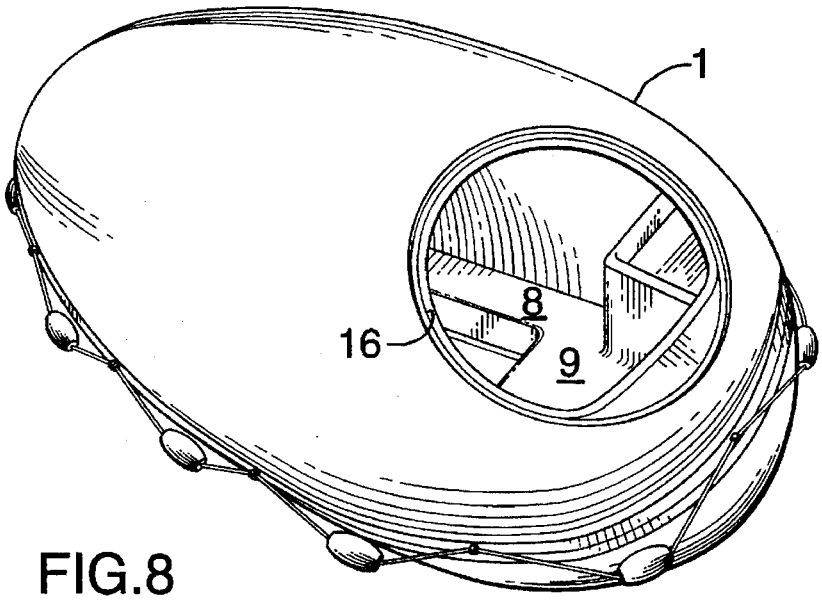
FIG. 8 is an external view of the capsule with the hatch removed.
Figure 9:
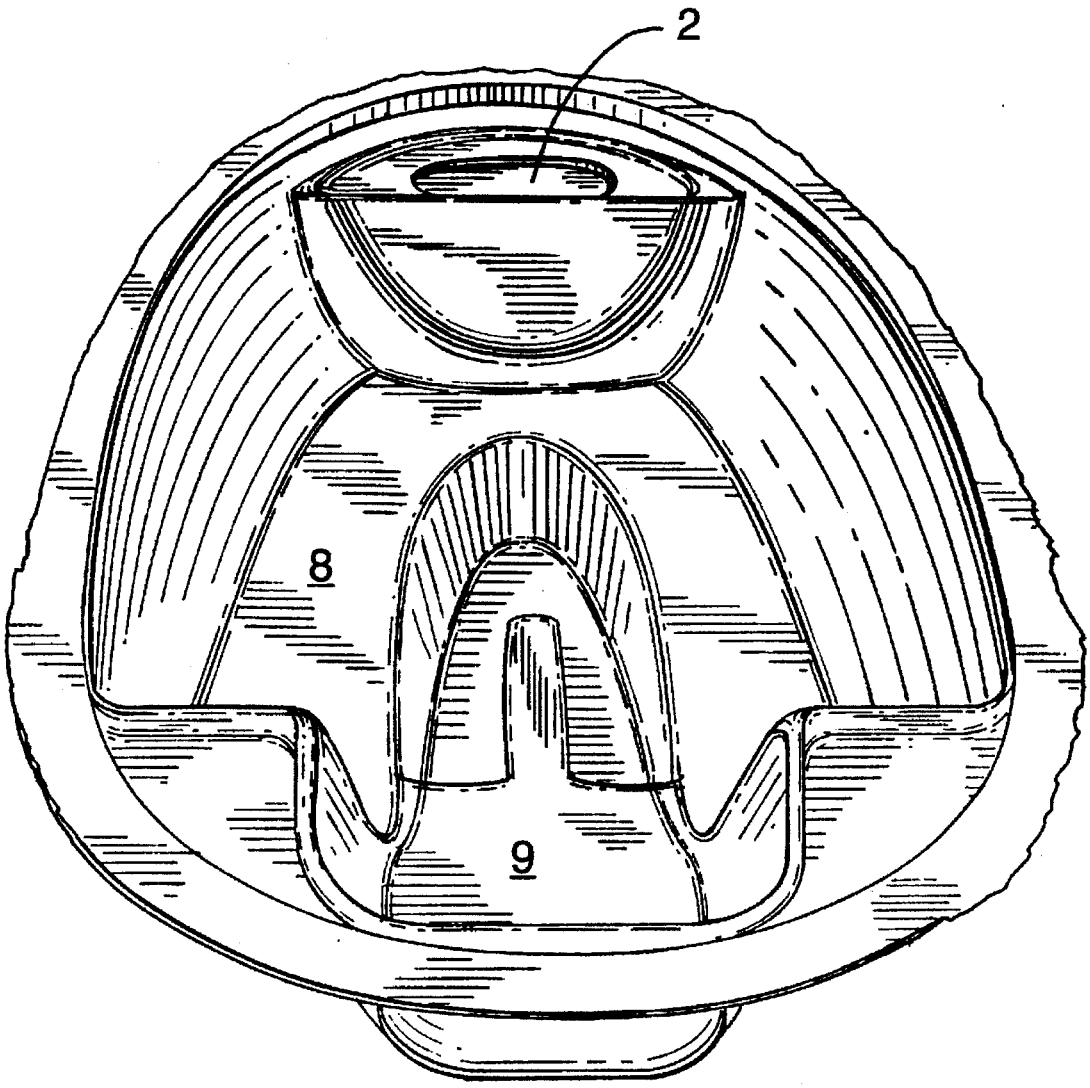
FIG. 9 shows the moulded inner hull shell from the hatch end.
Figure 10:
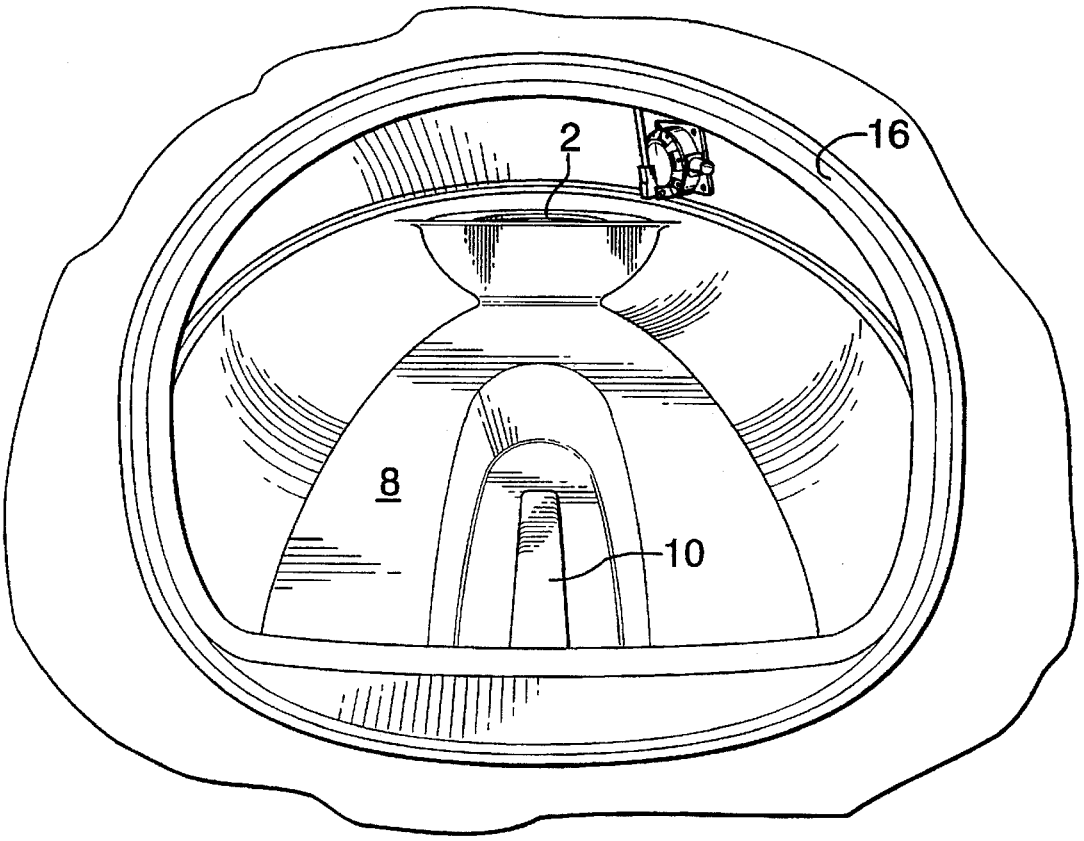
FIG. 10 shows the view in through the hatch.
Figure 11:
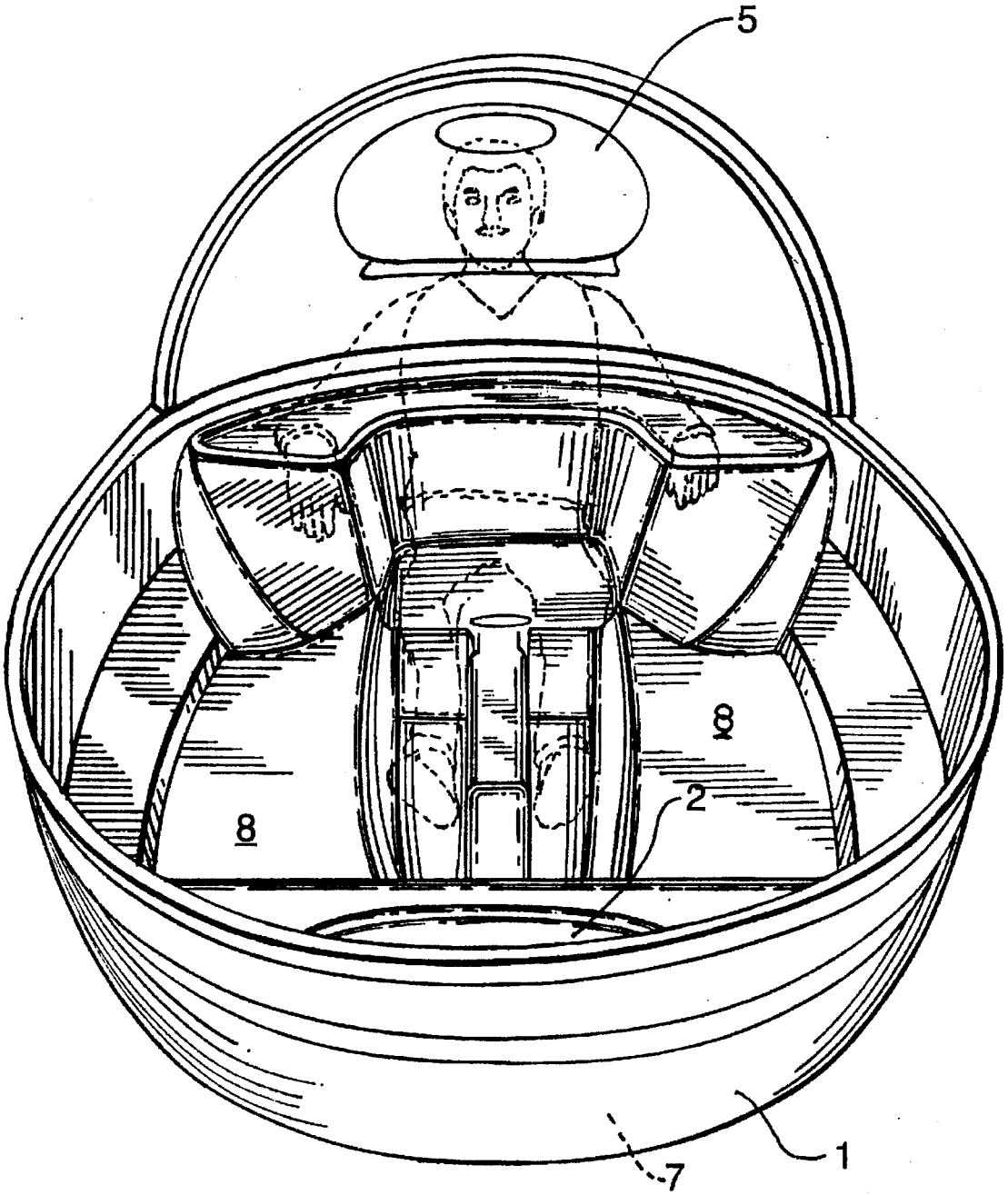
FIG. 11 shows the seat for the last man in, with the hatch opening above and behind.
Figure 12:
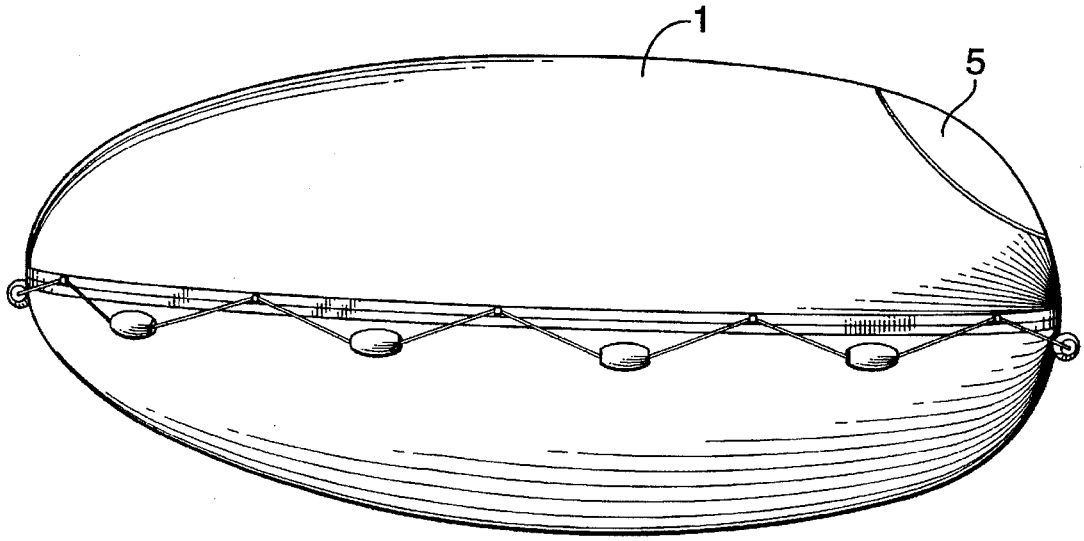
FIG. 12 shows the side view of capsule, with its profile and smooth lines.
Figure 13:
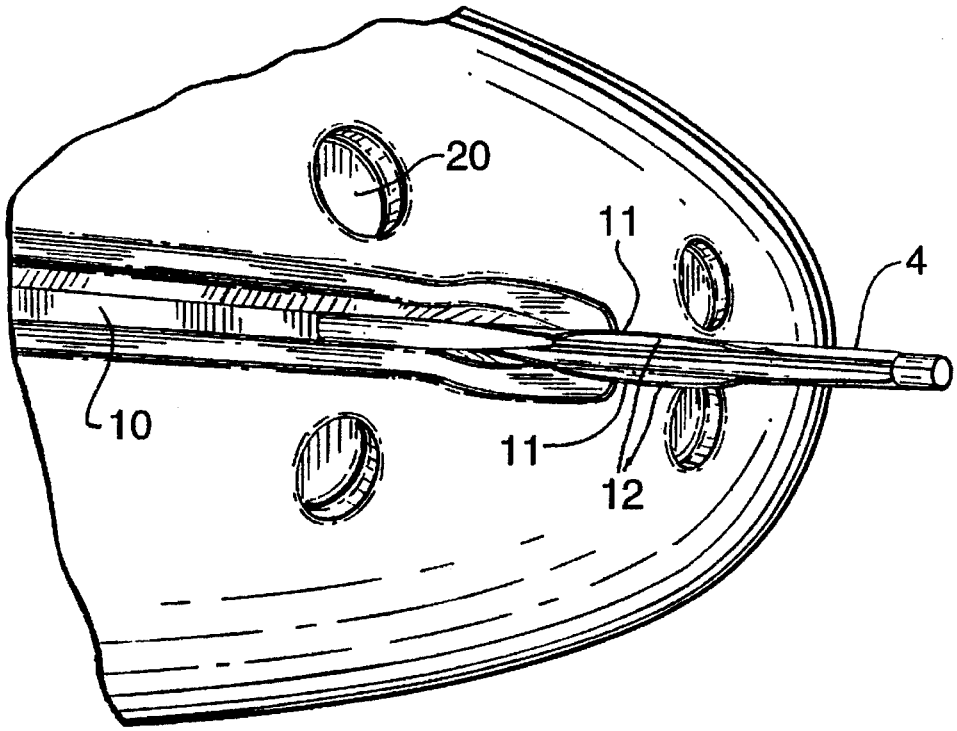
FIG. 13 shows the dagger board with flaps closed and the starter-water trap, which starts blades or flaps opening on a forward stroke of the operating handle.

The capsule 1 is shaped like a somewhat elongated egg, and has an inside shell which is moulded slightly smaller. As listed above, principal features of the preferred embodiment of the capsule include: a front end porthole (not illustrated); a front end opening (not illustrated), for the tow line, anchor line, or sea anchor; a chain/rope locker 2, which, when a plastic bag liner is employed, also functions as a toilet; ballast tanks 3 which flood with water when the capsule is placed in water; internal seating and geometry, described below in greater detail; a multi-function deride 4 which functions as a dagger board/keel, a rudder, and a propulsion system; a conventional diaphragm-type bilge pump or pumps (not illustrated); a multi-feature door system 5; a fully circular profile, above and below the normal water line; miscellaneous compartments 6 for stowing supplies; and foam flotation 7.

Some of the more inventive features of the capsule are described in greater detail below. The section numbers correspond to the numbers for the features listed above in the section "Disclosure of Invention":

2. Small End (bow) Opening

The bow opening must be sealed from the outside, so that external water pressure will tend to seat its plug solidly. However, the hole must also be tapered in a way such that at least a portion of it has the "small end pointing out". This enables a towing plug to be inserted to grasp the tow line, and distribute towing forces to the shell in a safe manner.

Basically, these geometrically conflicting requirements can be met with the equivalent to "two bath tub plugs back to back".

The outer plug, with its small end pointing inward, will be held in place when the capsule is being stowed on deck by a flag pin which is released as the capsule is launched. In this manner, it is not possible for water to enter the capsule through the bow prior to launching. The plug would be made from an elastomeric material which was cast around a double-eyed rod, to which was attached the sea anchor line (outside) and the bow line (inside).

The inner plug, with its small and pointing outward, would be made from much harder and stronger material, and would have a "slider hole", through which the bow line would freely pass. When it was desired to take a tow, or otherwise lock the rope to prevent payout, a rope lock would be employed to prevent rope outfeed.

An alternative to the above is to employ a double eyed through bolt, which is locked inside the capsule during stowage, and which can be released at any time by an occupant inside the capsule.

3. The Chain/Rope Locker and Toilet

A compartment 2 in the bow serves as a stowage place for the rope required for the towline/anchor system. In bad weather conditions, when bowel movements cannot be made from the stern of the capsule, rope can be removed from the locker, and it can be fitted with a plastic bag liner to permit its use as a toilet. The shape of the inside of the bow is such that the person using the toilet can wedge himself in place against the upper section of the capsule. This is important in a heavy seas condition. It has also been found that the fetid odour problem is surprisingly small when using the plastic bag method for fecal matter containment.

4. Ballast Tank System

Figure 14:
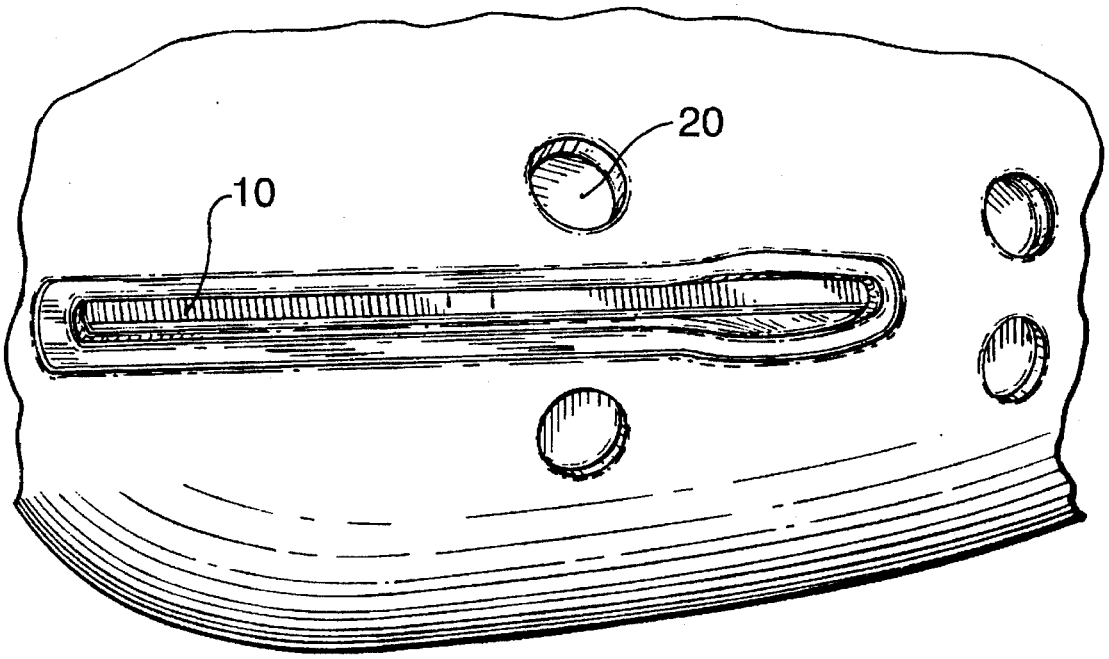
FIG. 14 is of the underside of the hull, showing the dagger box, plus four recessed water ballast holes (not drilled) to ballast tanks under the side seating.
Figure 15:
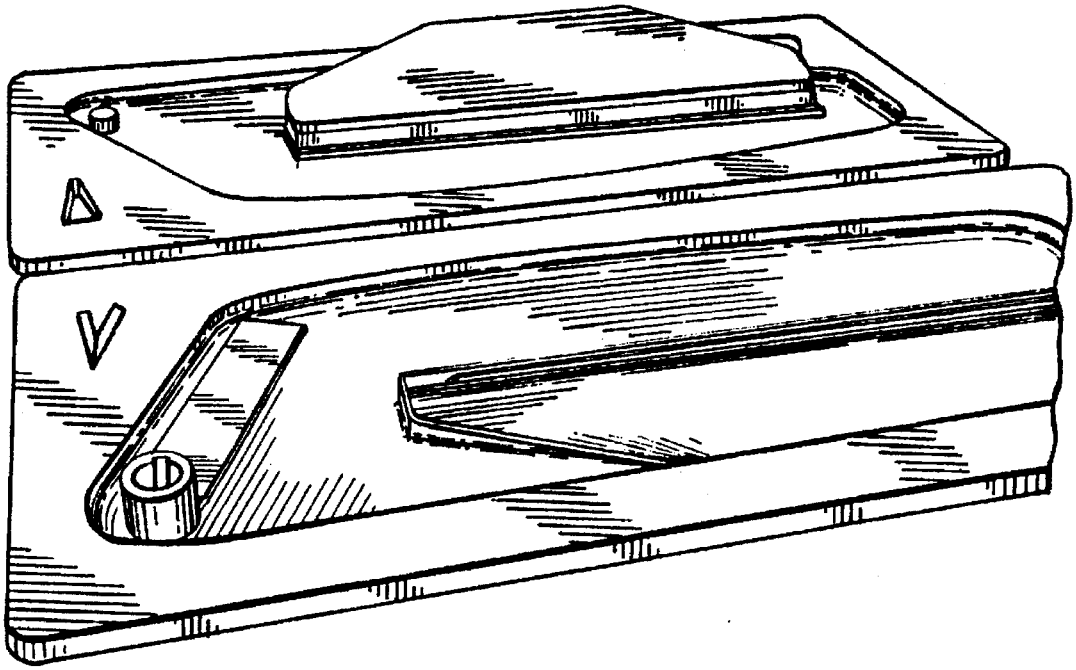
FIG. 15 shows the dagger board moulds, showing one flapper blade back and the internal shaft lock.
Figure 16:
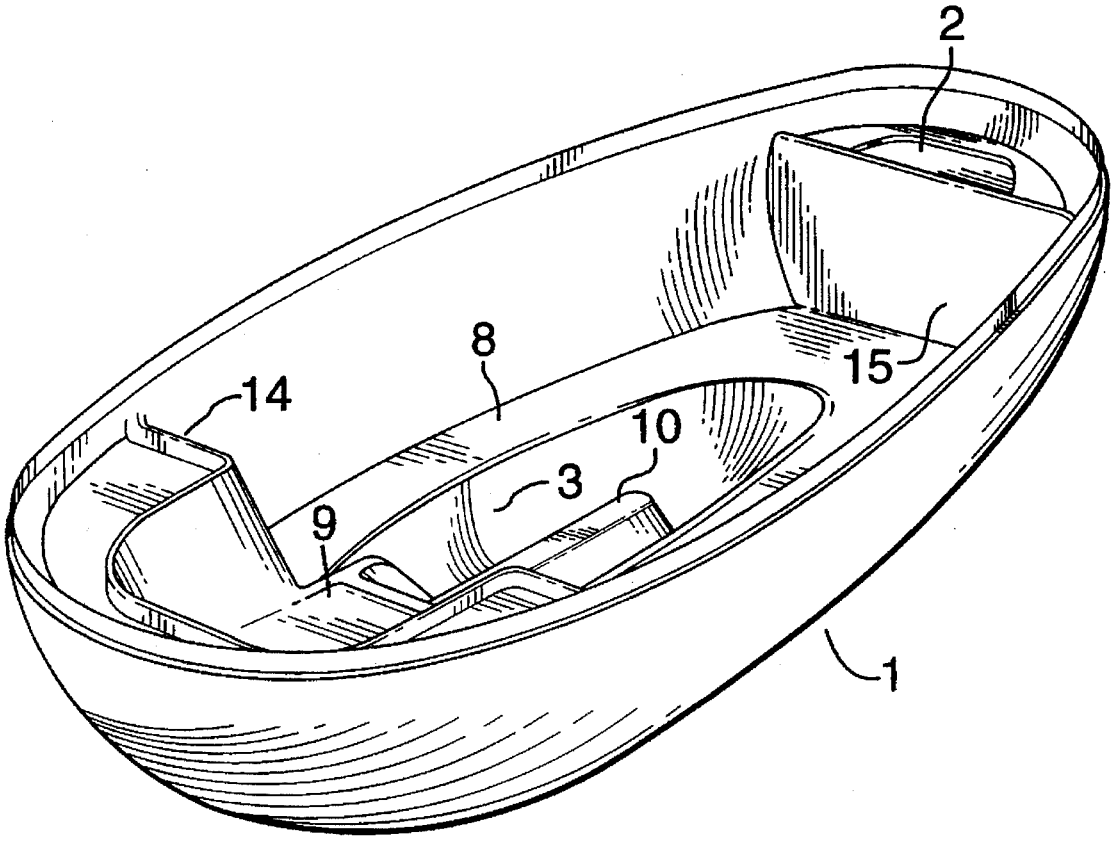
FIG. 16 shows the inner and outer hull.
Figure 17:
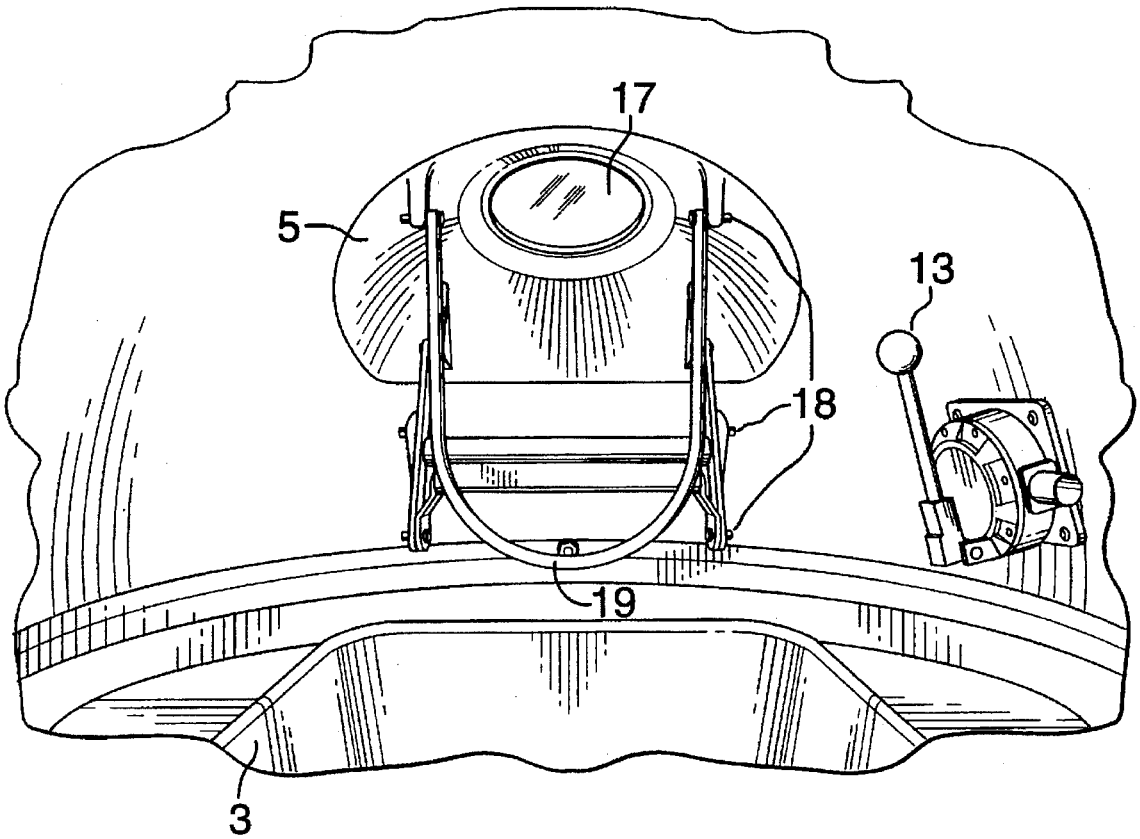
FIG. 17 shows the hatch closed.

The capsule employs ballast tanks 3 under the side seats, which are designed to provide adequate strength to prevent rupture when the capsule is submerged. FIG. 14 shows four recessed water ballast holes 20 (not drilled) to the ballast tanks. The tanks provide approximately 100 kg. (230 lbs.) of instant ballast.

5. Seat System (See also Sec. 8)

The seat system design is unusual, in that in has a very steep seat angle. While most chairs and seats have an angle to the vertical in the range of 80 to 90 degrees, the seat employs an angle of between 45 degrees to 80 degrees from the vertical. Two major advantages ensure:

1. The body can adopt the fetal position, which is comfortable for extended periods, while being provided with a large bearing area on the upper leg, or thigh muscle, on which the individual sits.
2. In this position, in conjunction with the back and foot rests provided, the individual can lock himself in place, with very little effort and stress, to resist movement, when the capsule is tossed by heavy seas.

The seating includes bench areas 8, and a seat 9 beneath the hatch for the last man into the capsule.

6. Dagger Board/Keel/Rudder/Propulsion System

The capsule employs an especially useful device 4 which serves four necessary functions, while being simple and durable. All this is accomplished with only one through hull penetration.

The device is basically a dagger board which is retracted up into the dagger board box 10 by rotating it. It remains outside the capsule, but it can be partially retracted, to retain a conventional keel effect for axial stability, or it can be fully tucked up within the dagger board box, to permit perfect retention of the circular profile of the capsule, when desired.

Attached to each side of the basic dagger board are two flaps or cheeks 11 which are attached by hinges. A starter-water trap area 12 is provided to start the blades or flaps opening on a forward stroke of the operating handle 13. By rotating the operating handle toward the stern, the dagger board is deployed, but while it is being rotated toward the bow, the flaps for cheeks splay apart to form a shape which catches the water, and enables rearward thrust, and acts as a propulsion system. The device is especially effective if the ends of the cheek flaps contact the entry of the daggerboard box prior to the end of the thrust stroke. This causes partial closure of the cheek flaps, which causes the water contained between the cheek flaps and the dagger board body to accelerate prior to exit. The result is a significant increase in propulsive thrust.

The same device can also act as a rudder, to provide steerage for the capsule, Simply by having the occupants shift their weight to the side of the capsule to which it is desired to change direction.

8. Internal Geometry and Seats (See also Sec. 5)

Comfort in a confined space over an extended period is very important in a craft of this nature. The proportions of the interior of the capsule have been designed to enable the occupants to remain comfortable over an extended period, with a minimum expenditure of energy and a maximum degree of relaxation. The key, in this ergonomic design, is the ability of the occupant to adopt a semi-fetal, semi-supine position, which is very restful.

The specific features are:

1. A radius of curvature for back and head support of about 0.6 m (2 feet)
2. An angle for seat back 14 which is between 45 degrees and 80 degrees from the vertical
3. A foot rest 15 which is located at a suitable position.

Figure 18:
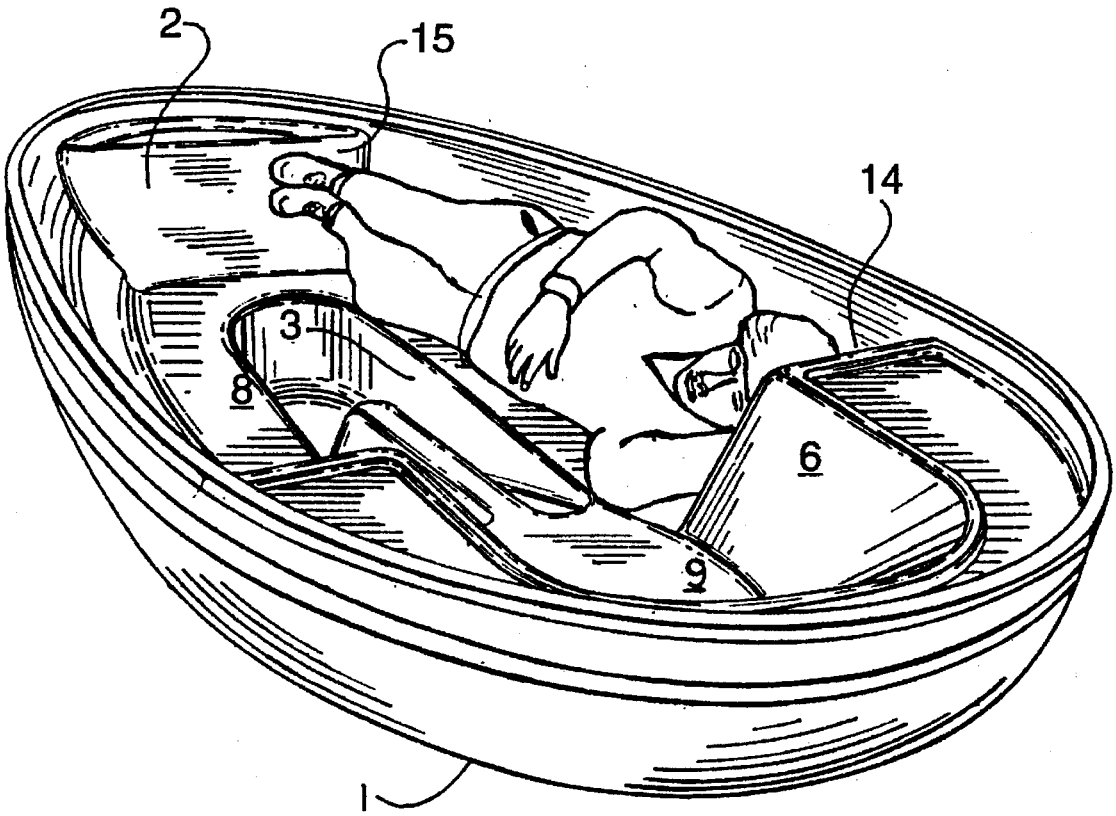
FIG. 18 shows a person prone in the capsule.
Figure 19:
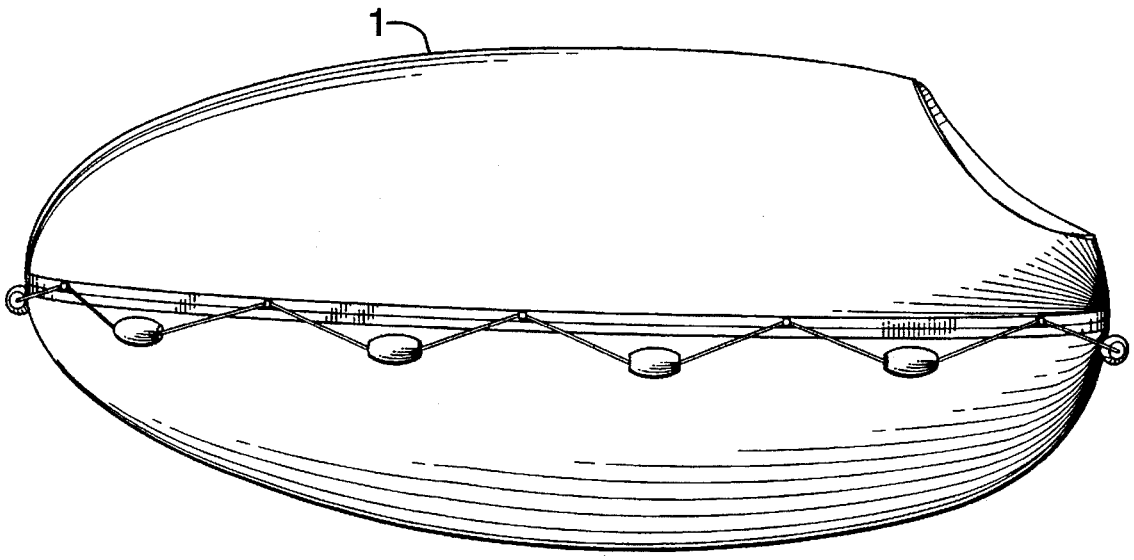
FIG. 19 shows a side view of the capsule with the hatch removed.
Figure 20:
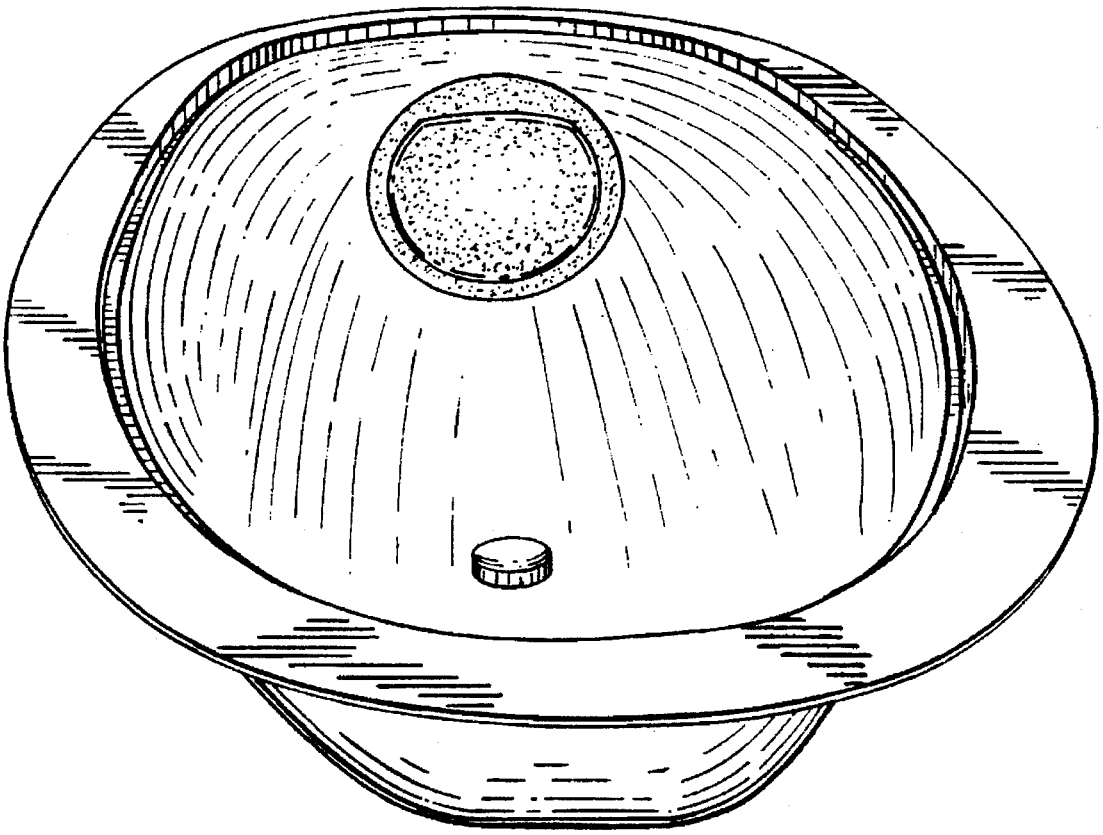
FIG. 20 is of the upper mould, showing the balsa core and hatchway.
Figure 21:
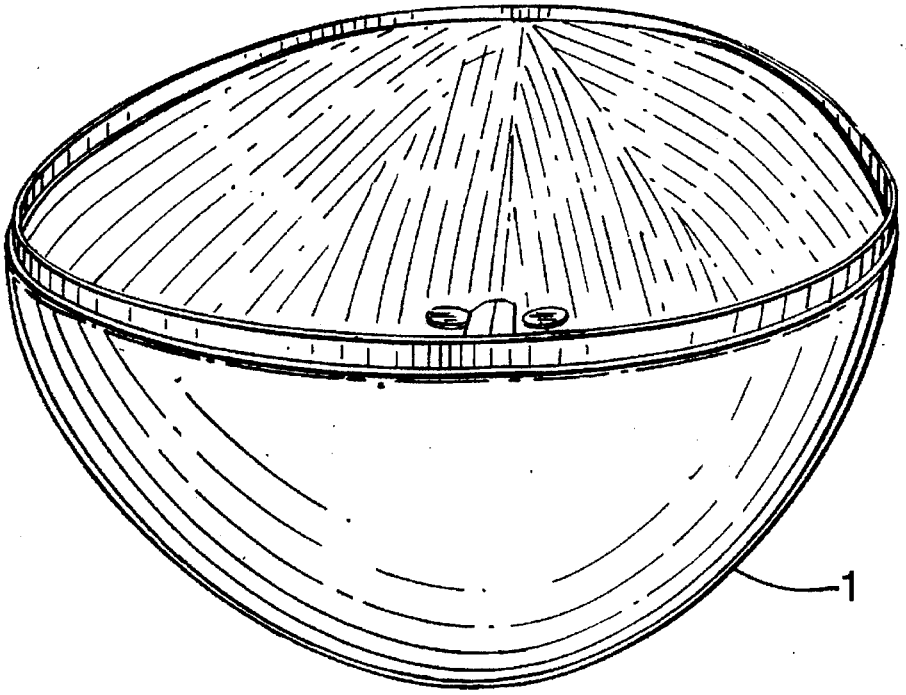
FIG. 21 is a view of the hull, showing the bonding flange, balsa core, dagger box and two of four water ballast inlets.
Figure 22:
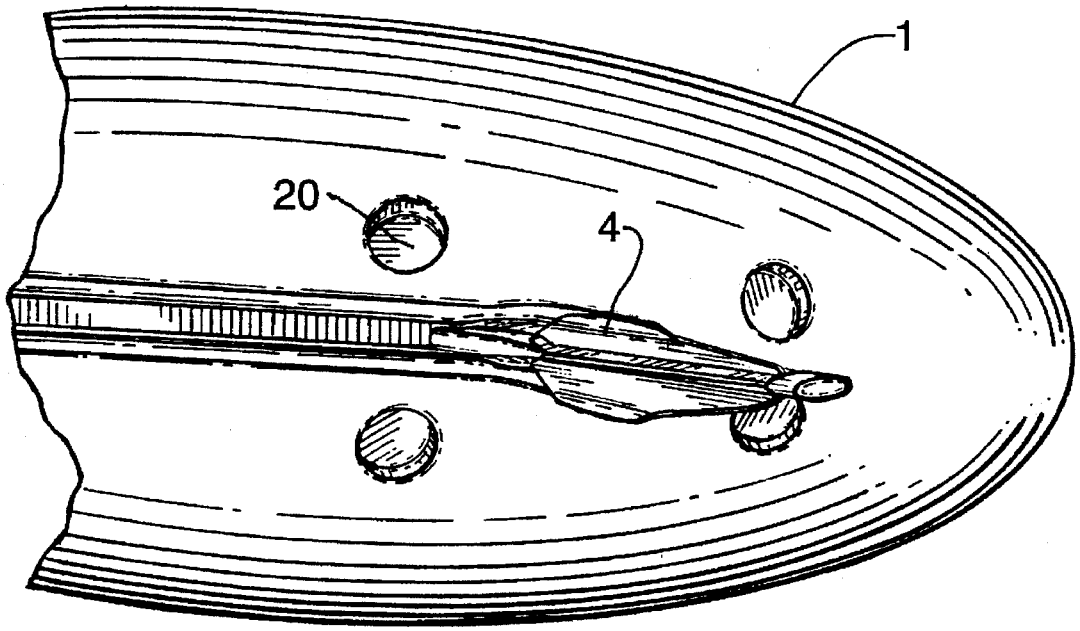
FIG. 22 shows the dagger board with flaps fully opened, viewed from behind.
Figure 23:
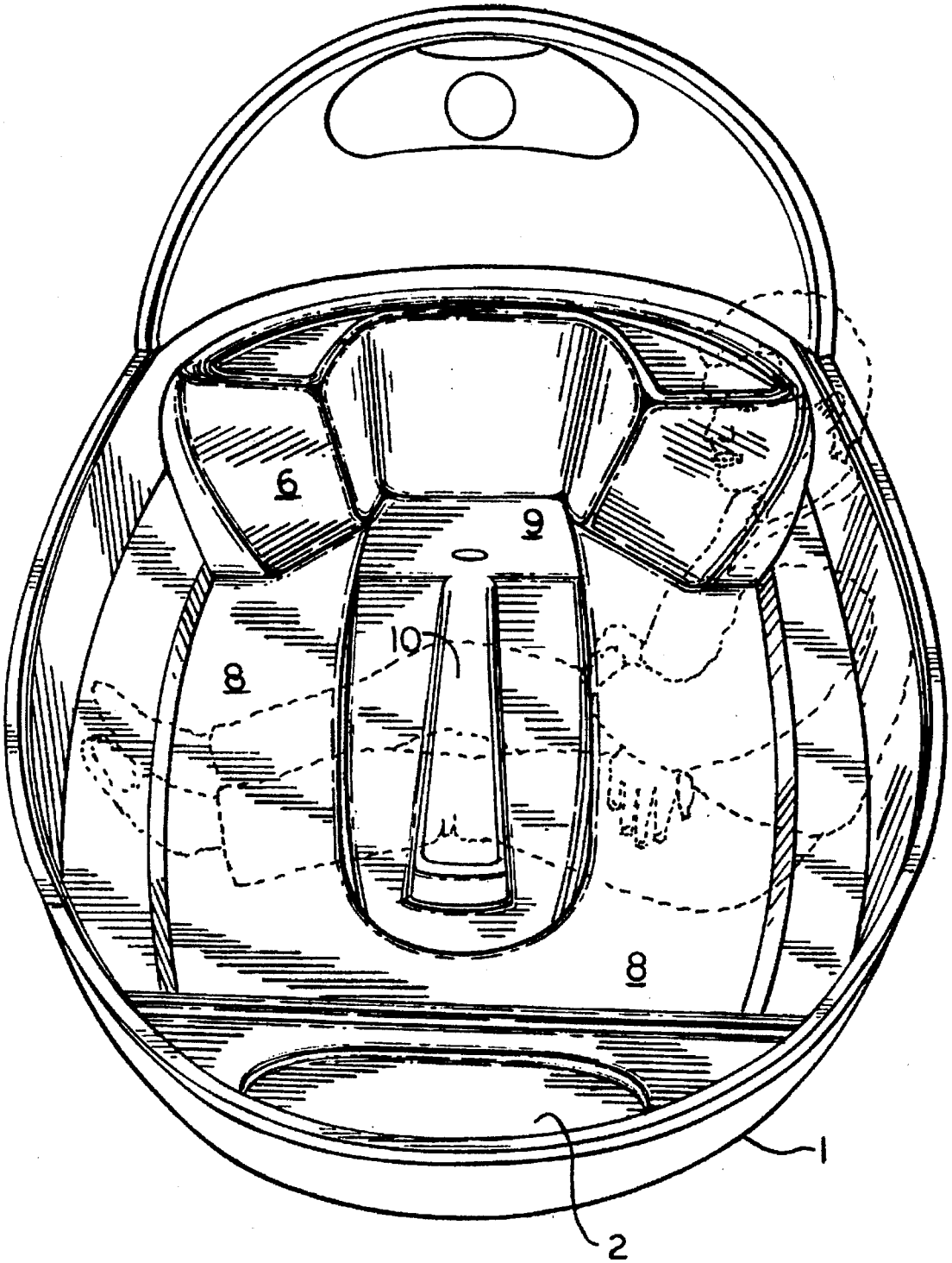
FIG. 23 shows typical cross-seating.
Figure 24:
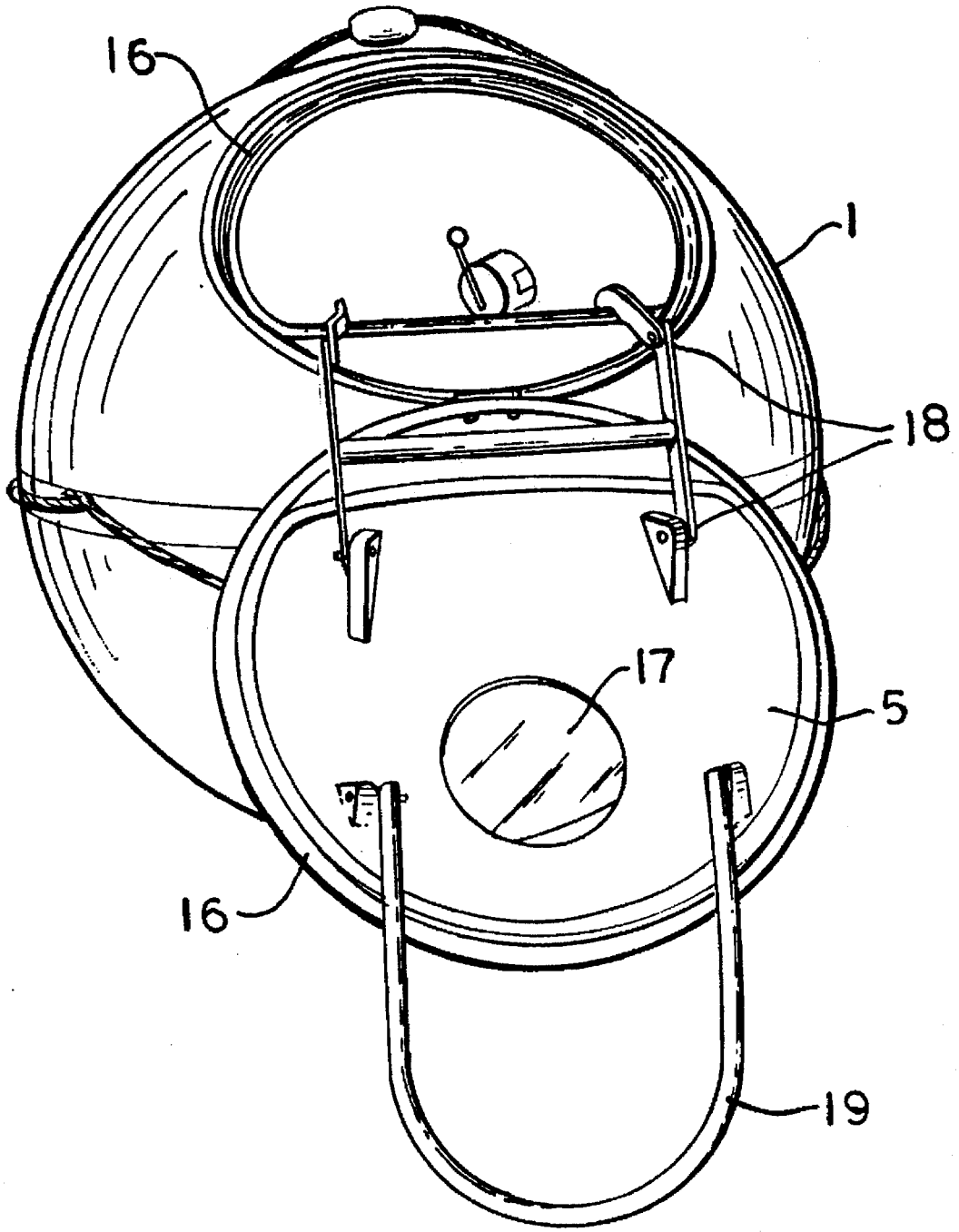
FIG. 24 shows the hatch entry system, without rubber seals and locking pins are not in place.

This geometry permits a person to effectively lock himself in place, as shown in FIG. 18, with little effort required to prevent being thrown about from capsule movement.

This geometry will work as long as the coefficient of friction between the person's clothes and the capsule wall is greater than a certain amount.

The seats are unique, in that they are very comfortable while being very narrow. While conventional seats have a dimension in the direction along the thighs of 30 to 45 cm (12 to 18 inches), these seats can be as narrow as 20 cm (8 inches) along the thigh and still be very comfortable. It has been found that two additional factors are important in seat design:

1. The height of the back support 14; and
2. The coefficient of friction between the person's clothing and the seating system.

Also important are:

1. The radius of the curve connecting the back support element with the seat support element; and
2. The radius of curvature of the far end of the seat, where it leaves the thigh, and the angular distance through which it is employed.

Further work is necessary to determine the actual limits of seat geometry.

It is interesting and important to note the importance of the coefficient of friction of the seat and back support areas. On the one hand, having an overall geometry which enables the person to comfortably wedge himself in place to prevent sliding and movement while requiring only a low coefficient of friction is advantageous, in that a low level of effort is necessary to create the normal forces which in turn lead to the restraining frictional forces.

On the other hand, a high coefficient of friction enables the lower back area of the person to become effective and useful in carrying the persons weight, thus permitting an apparently smaller seat area.

10. Multi-feature Entry Door System

The entry door or hatch 5, is unusual for a number of reasons:

1. Because of a double lip arrangement 16 around the perimeter of the hatch and its opening, the hatch acts to strengthen the shell opening, which is necessary for entry to the capsule, but additionally, it enables the door to be locked in place very securely with only two small and simple locking pins.
2. It is double walled, and curved for strength.
3. It employs an integral porthole 17, to provide a view to the outside, and to admit light.
4. It is hinged on the bottom, via a three-point binge 18, so that when opened, it folds downward.
5. It employs a "fold-out" extension step 19 to permit easy entry, whether from a deck, or from the water.
6. Two water seals can be employed in a manner where external pressure on the door acts to enhance the water seal effect.

11. Life Support Environmental System

Being a totally enclosed capsule, it must have a positive life support system enabling the occupants to survive expected conditions. Features which are addressed include:

1. Retention of heat, for cold water situations
2. Humidity control
3. Air exchange, to meet physiological oxygen requirements
4. Air exchange, to meet the ventilation requirements for sweeping away foul odours
5. Control of heat build-up 12. Submersible Feature The capsule has been designed with adequate strength, and with waterproof openings, to permit submergence without endangering the occupants. Indeed, the preferred launch method is to wait until the ship has settled below water level prior to releasing the capsule. Two levels of deployment are employed: manual, and automatic. The capsule is automatically deployed by means of a hydrostatic release device which disables the restraining system when it sinks to a depth of between 1 meter and 4.5 meters.

This appears to be an unusual method of launching a life-saying craft. However, to avoid being classed as a submarine, which would entail enormous strength and environmental maintenance requirements, it is necessary to specify limits to submersibility, in terms of:

1. Maximum recommended operating depth (say 15 feet, or 4.5 meters)
2. Maximum recommended submergence time (say 15 seconds)

13. Fully Circular Profile

The fully circular profile, below and above the water line, appears unique. This profile is surprising, in that conventional thinking suggests that there be protruding fins and such like appurtenances to stabilize the capsule. While this is true for a large vessel, under power, and having a relatively large profile above water, it is not true for a small craft, unpowered, and with an above-water profile which is relatively small in comparison to its below-water profile.

The proposed family of capsules will be fully circular in profile, i.e. at each profile station, the capsule will appear circular in cross section. While the centres of the profile circles can be above or below an imaginary horizontal centre line, it is generally preferred that they be on this imaginary line. The circular profiles should preferably be smaller at both ends than at the middle, to present a blunted profile to the wind and the water. Additionally, it is preferred that the average size of the circular profile sections be larger at the stern end of the capsule than at the bow end. In contrast to a shape which would be elliptical if the bow and stern profiles were equal, the preferred shape attained is somewhat like an egg.

The general advantages of this shape are strength, stability, and the lack of protruberences to act as points of force concentration, either mechanical or hydrodynamic. A specific advantage of this shape is that it enables installation of a hatch which is disproportionately large for the general geometry, while permitting it to blend in perfectly with the overall geometry.

14. Launching System

As touched on in Section 12 above, the launching system will permit release of the capsule from its mounts either when above or below water, manually or automatically, or from inside or from outside the capsule.

When launched from above water, it is released and is simply allowed to fall in an unconstrained or unsupported manner. This is practical, in that there is no danger of being swamped, overturned, or sunk because of having taken on water. The limit to the height through which the capsule can be dropped is determined by the g forces which the occupants will experience on impact with the water. Instrumented drop tests will determine how the capsule penetrates the water when dropped, and the g forces which result.

INDUSTRIAL APPLICABILITY

This invention provides a maritime survival capsule, intended for emergency use, such as when a ship is sinking.

I claim:

1. A maritime survival capsule, comprising an outer shell which is generally egg-shaped, thus having a generally circular cross-section with a relatively broad stern and a narrower bow, and a sealable entry hatch across a hatch opening through an upper portion of said shell adjacent said stern, pivotally attached to said shell via a hinge mechanism between said hatch and said shell, adjacent a bottom edge of said hatch and said hatch opening, such that when opened, said hatch folds downwardly and away from said hatch opening, said hatch having an extension step pivotally mounted adjacent an upper edge thereof, pivotable away from said hatch so as to extend downwardly and away from said hatch when said hatch is open.

2. A capsule as recited in claim 1, where said capsule has inner and outer shells, and has ballast tanks between said inner and outer shells, which flood with water when the capsule is placed in water.

3. A capsule as recited in claim 1, further comprising seating within said capsule integral with said capsule, including bench areas along either side thereof, a foot well extending downwardly between said benches, and a seat under said hatch for seating the last person to enter the capsule.

4. A capsule as recited in claim 2, further comprising seating within said capsule integral with said capsule, including bench areas along either side thereof, a foot well extending downwardly between said benches, and a seat under said hatch for seating the last person to enter the capsule.

5. A capsule as recited in claim 4, where said bench seats are defined by said inner shell, and where said ballast tanks defined between said inner and outer shells beneath said bench seats.

* * * * *